United States Patent [19]

Broussard, Sr.

[11] Patent Number: 5,074,557

[45] Date of Patent: Dec. 24, 1991

[54] TABLE TOP FOOTBALL GAME APPARATUS

[76] Inventor: Staffas Broussard, Sr., 2110 St. Bernard Ave., New Orleans, La. 70119

[21] Appl. No.: 297,311

[22] Filed: Jan. 12, 1989

[51] Int. Cl.[5] ..... A63F 7/06

[52] U.S. Cl. ..... 273/94; 273/DIG. 31; 273/85 F; 273/86 B; 273/367; 273/85 E

[58] Field of Search ..... 273/94, 85 F, 85 E, 273/85 R, 86 B, 85 B, DIG. 31, 367, 370, 1 E

[56] References Cited

U.S. PATENT DOCUMENTS

| | | | |
|---|---|---|---|
| 2,148,354 | 2/1939 | Hurlock | 273/94 R |
| 2,780,461 | 2/1957 | Ryan | 273/94 R |
| 2,827,296 | 3/1958 | Walker | 273/86 B |
| 3,046,015 | 7/1962 | Schuh et al. | 273/94 R |
| 3,315,962 | 4/1967 | Budai | 273/94 R |
| 4,765,622 | 8/1988 | Rienzo | 273/85 R |

*Primary Examiner*—Edward M. Coven

*Assistant Examiner*—Sebastiano Passaniti

*Attorney, Agent, or Firm*—Pravel, Gambrell, Hewitt, Kimball & Krieger

[57] ABSTRACT

A table top football game apparatus includes a table like base having a generally horizontal playing surface. A plurality of elongated parallel slots are provided on the playing surface and a plurality of football player figurines are moveably mounted upon the plurality of slots for sliding travel thereupon, between end portions of the playing surface which are respective goal lines. The players are moved in the slots and independently of one another by a plurality of controls mounted at the end portions of the table which correspond to the opposing goal lines. At least some of the figurines face in opposite directions thus defining offensive and defensive players. The spaced offensive and defensive controls move the respective players up and down the slots and contacts are provided for forming a connection between two players facing in opposite direction to signify a tackle for example.

9 Claims, 10 Drawing Sheets

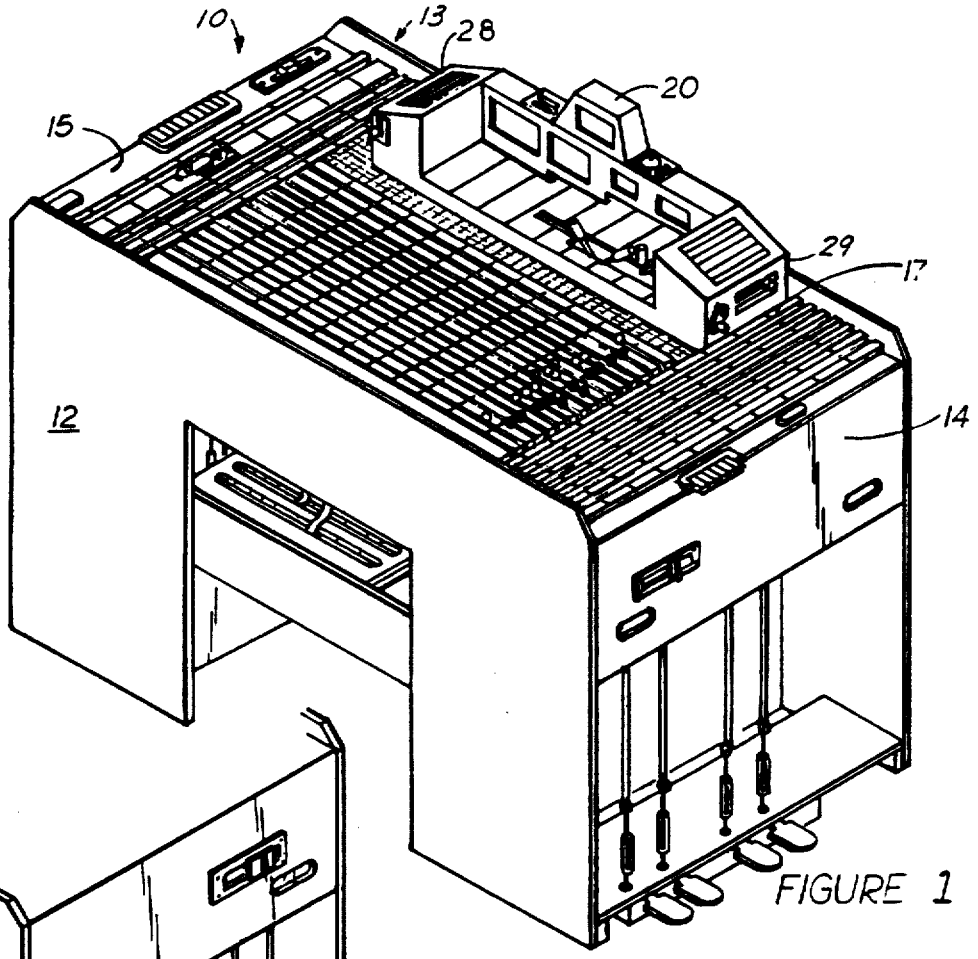
FIGURE 1
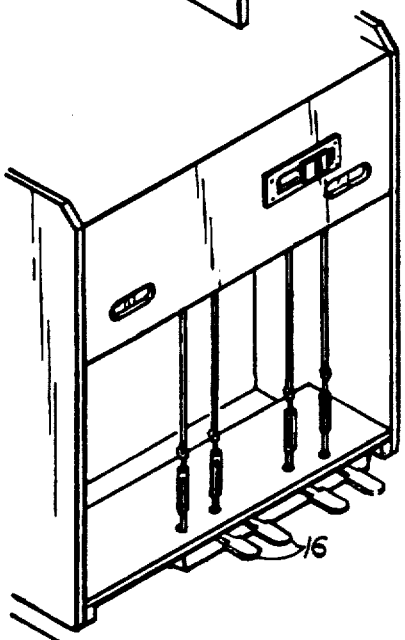
FIGURE 2
FIGURE 3
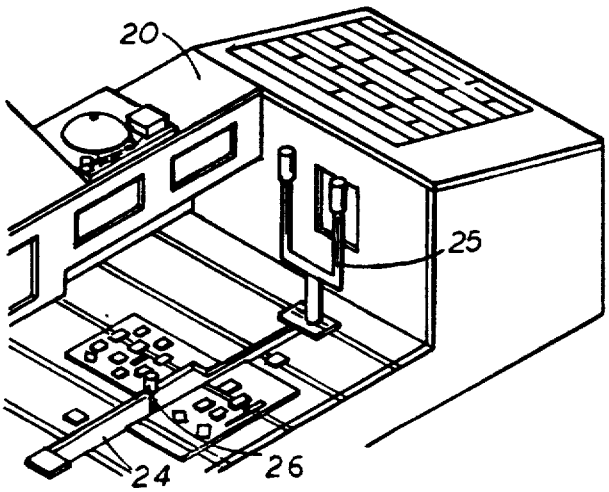
FIGURE 4
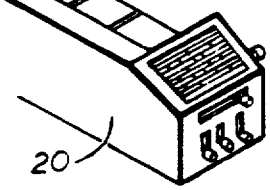

FIGURE 11
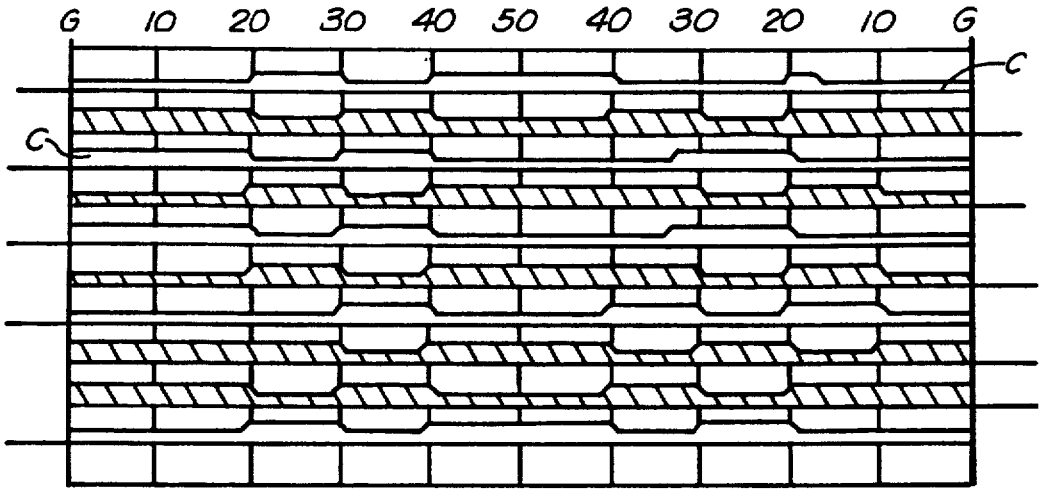
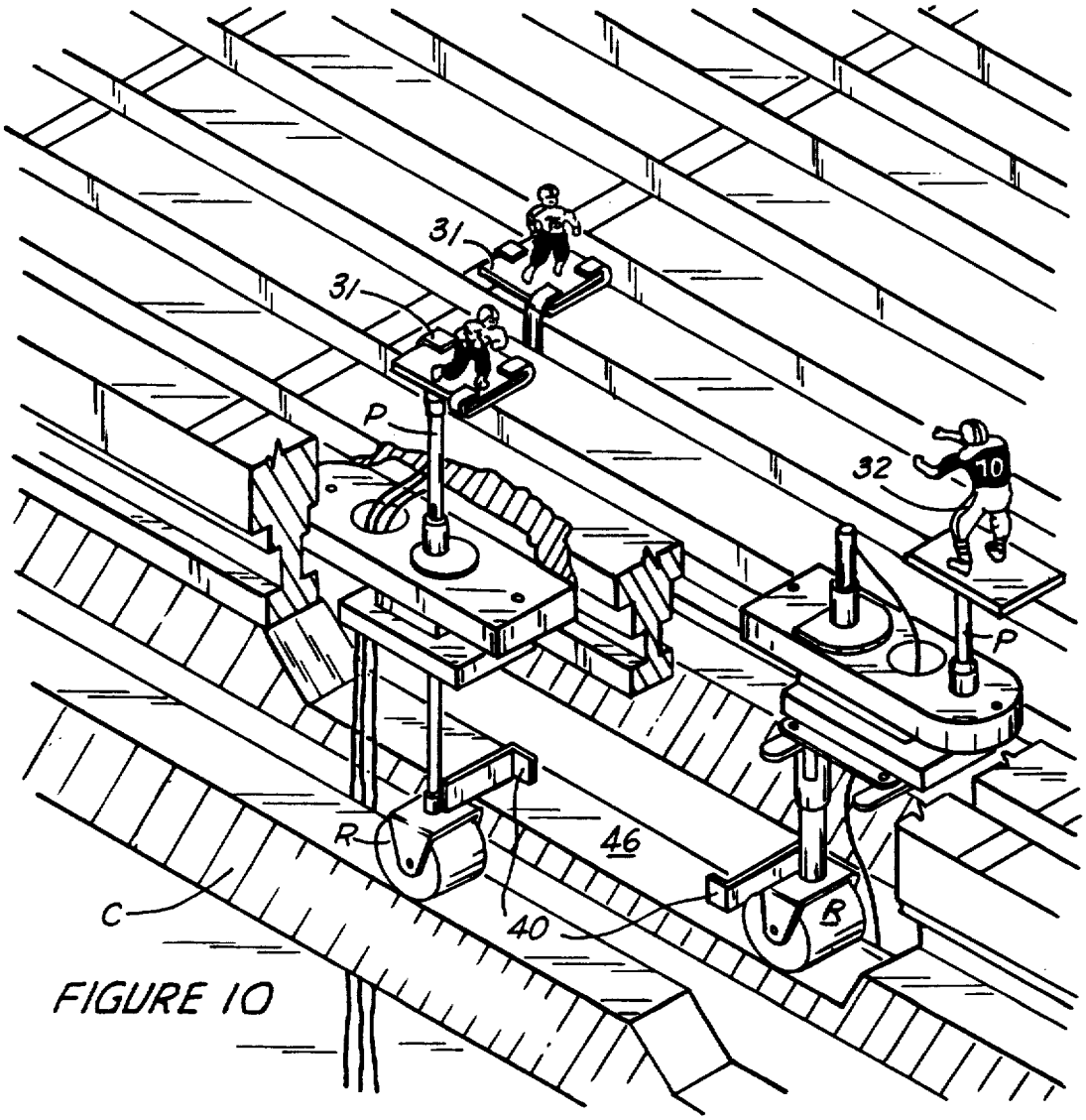
FIGURE 10

TABLE TOP FOOTBALL GAME APPARATUS

BACKGROUND OF THE INVENTION

1. Field of the Invention

The present invention relates to table top games and more particularly relates to an improved table top football game apparatus which is played on a table top surface having a plurality of generally horizontal slots with football player figurines traveling in the slots.

2. General Background

American football is a game which uses a field one hundred yards in length and which has two ten yard deep end zones. The field is marked in ten yard increments. During play a team carries the football for successive downs attempting to move the ball to the end zone for a score.

Football is a well publicized and popular sport and there are numerous miniature versions of football in the form of indoor games which include numerous variations.

In one variation, "electric football", a vibrating, usually metallic board surface is used. The eleven offensive and eleven defensive football player figurines are placed on the board, each player figurine having an undersurface which is beveled tending to move the players forwardly when they vibrate upon the board. The vibration is caused by a small eccentric motor mounted underneath the board. Play is started by turning the electric motor on, and moving the eccentric to vibrate the board. When the offensive player is touched by one of the defensive player, the play is over.

In other versions of football, playing cards can be used to deal from a stack a certain play which is random and chance. In another version of a miniature game of football, a spinning pointer can be used to designate the yards that an offensive player moves at each time the ball is advanced.

Most of these table top forms of miniature football are relatively simplistic and uncomplicated thus becoming somewhat boring to the user after a short period of time.

The present invention provides a much more sophisticated and complex football game which requires manual as well as mental skills on the part of the player having movement of both foot petals and hand operated slides, and requiring good instincts for timely raising and lowering cam surfaces which are used to avoid and/or make tackles.

Thus, the present invention provides a challenging, complicated, complex and many faceted football apparatus which closely simulates the real game.

The table top game surface is in the form of a large table such as for example the present, commonly seen football table top units as well as the table top soccer and air hockey games as far as size and scale. However, the present invention is more complicated providing a complex variation of plays and moves as well as a complex combination of foot petals and hand slides which make the game fascinating, challenging, and exciting.

SUMMARY OF THE PRESENT INVENTION

The present invention thus provides a table top football game apparatus which includes a table like base having a generally horizontal playing surface.

A plurality of elongated parallel slots are formed on the playing surface. A plurality of football player figurines are moveably mounted upon the plurality of slots for sliding travel thereupon between the end portions of the playing surface.

Goal lines are provided at each end portion of the playing surface and these goal lines are traversed by the end portions of each slot so that the player can move along the slot to the other end zone, crossing the respective goal lines at each end. Foot pedal, cable 17 connected to hinges (horizontal and vertical) which releases brake to permit or allow the weight to pull men forward. Means is provided in the form of both foot petal and hand controls for moving each player figurine in its respective slot and independently of at least some of the other player figurines.

At least some of the figurines are faced in opposite directions thus defining offensive and defensive player figurines, as the offensive players face in one direction and the defensive players face in the other direction. First and second player controls are provided and on generally opposite sides of the table like base and are positioned at respective end portions of the playing surface adjacent the opposite end zones.

Contacts are provided on at least some of the player figurines performing an electrical connection with a player on an adjacent slot when the two player figurines move to a position adjacent one another and make contact. An audible alarm for example such as an electronic whistle sound, signifying a tackle. The present invention is complicated and more complex by providing position changing means which are operable by the controls mounted at each respected end portions i.e. (offensive and defensive) of the table like base so that positions of at least some of the players in their slots can be changed, misaligning the contacts of one player so that the one player can pass the other player without making contact such as a ball carrier avoiding a tackler.

With the present invention, then there are designed problems of anticipation when the offensive ball carrier moves his carrier into an elevational position using a cam surface and the defensive player does not anticipate or quickly react to such a misalignment. The offensive player can quickly move by the defensive player and for a score.

The present invention provides metallic contacts in the preferred embodiment but which are carried by each player figurine.

In the preferred embodiment the player reaching the end zone sounds an audible alarm such as a bell, thus registering a score.

In the preferred embodiment a kicking game is provided on the playing surface for mechanically acting out a football extra point play.

The kicking game includes a plurality of player figurines which are mounted on a game board. Below the game surface is a number of shafts, a pair of pendulums with a lamp, lock mechanisms, and a plurality of cables, springs, and pulleys which are shown in FIG. 4. The pendulum is designed to stay out of view until it is activated by a slide. When the slide is activated, the pin of the lock mechanism is disengaged and the spring on the shaft will swing the pendulum. The pendulum carries a lighted lamp which represents the game ball. The lighted lamp is moved back toward the kicker which is one of the moving player figurines. The pendulum swings toward the goal posts and one of the moveable players has rised in an apparent attempt to block the kick.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 is a perspective view of the preferred embodiment of the apparatus of the present invention;

FIG. 2 is a partial perspective view of the preferred embodiment of the apparatus of the present invention;

FIG. 3 is fragmentary view of the preferred embodiment of the apparatus of the present invention illustrating the kicking game portion thereof;

FIG. 4 and 4A are fragmentary views of the preferred embodiment of the apparatus of the present invention illustrating the kicking game;

FIG. 10 is a fragmentary view of the preferred embodiment of the apparatus of the present invention;

FIG. 11 is a schematic view of the cam arrangement of the apparatus of the preferred embodiment.

DETAILED DESCRIPTION OF THE PREFERRED EMBODIMENT

Figure 4A:
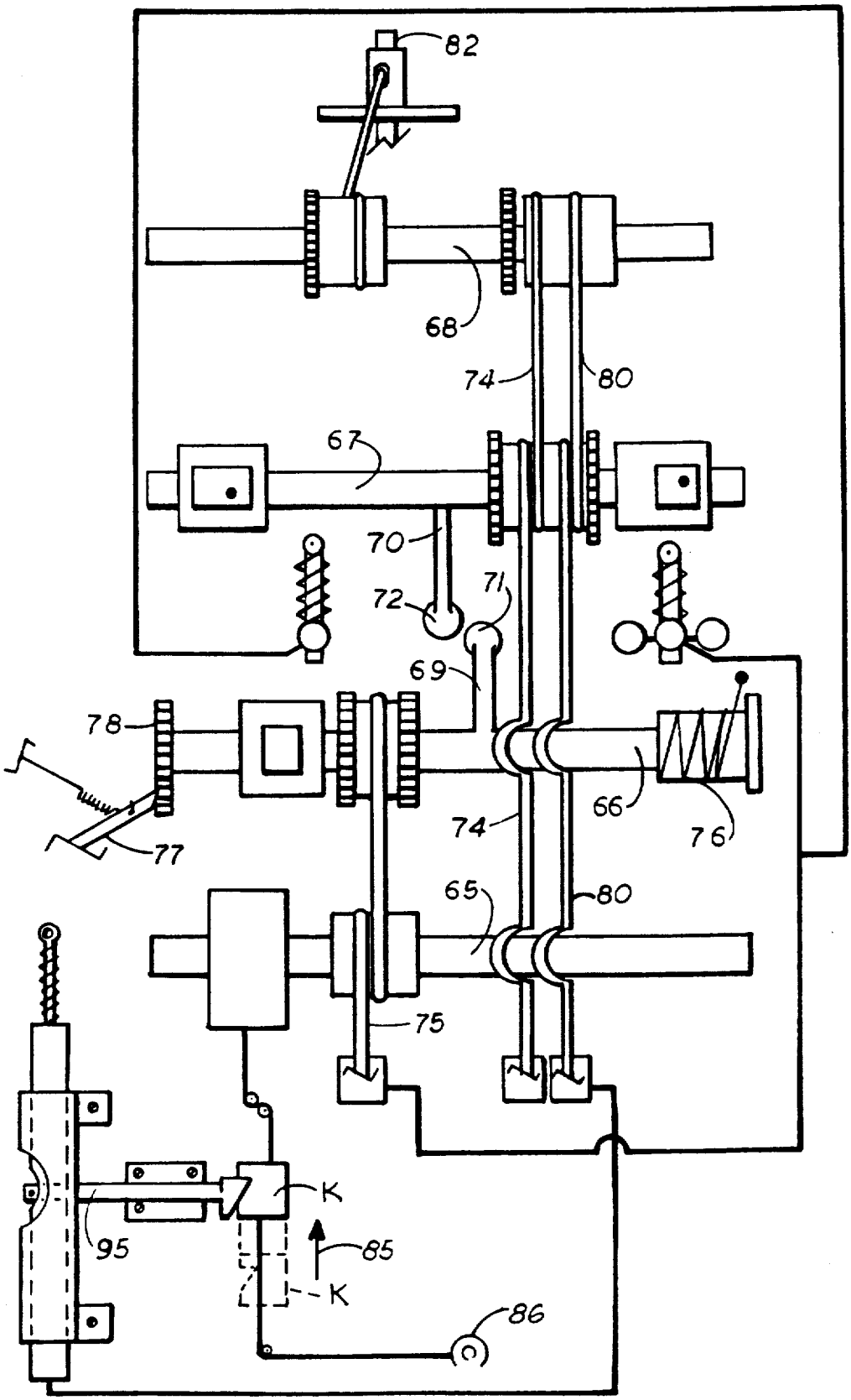

FIG. 1 illustrates the preferred embodiment of the present invention designated generally by the numeral 10. Football game apparatus 10 includes a table 12 which can rest on the floor for example and has an upper surface 13 which is designated as the playing surface. The playing surface 13 includes offensive an defensive end portions 14, 15 with each end portion including a plurality of foot petals 16 and a plurality of hand operated slides 17. The foot petals 16 co-operate with cables to raise and lower cam surfaces which elevate particular player figurines. The slides 17 are moved from left to right in order to move a particular player figurine in its respective slot.

Also provided as shown in FIGS. 3-4 is a kicking game which includes a console 20 having a playing surface surrounding an elongated slot 24. At one end portion of the slot 24 is a miniature goal post 25 through which an imaginary football can pass during an extra point play. A pendulum 26 moves in the slot 24 and represents the ball. The extra point play is basically a game of chance in that one end portion 28 of the console 20 has four selected numbers 1-4 and the other end portion 29 includes the same four numbers. If the defensive team selects the same number as selected by the offensive team, the extra point attempt is "no good". If however the defensive team selects a different number then the extra point will be good. In FIG. 5, the four numerical choices 1-4 are designated by the numeral 30.

Figure 7:
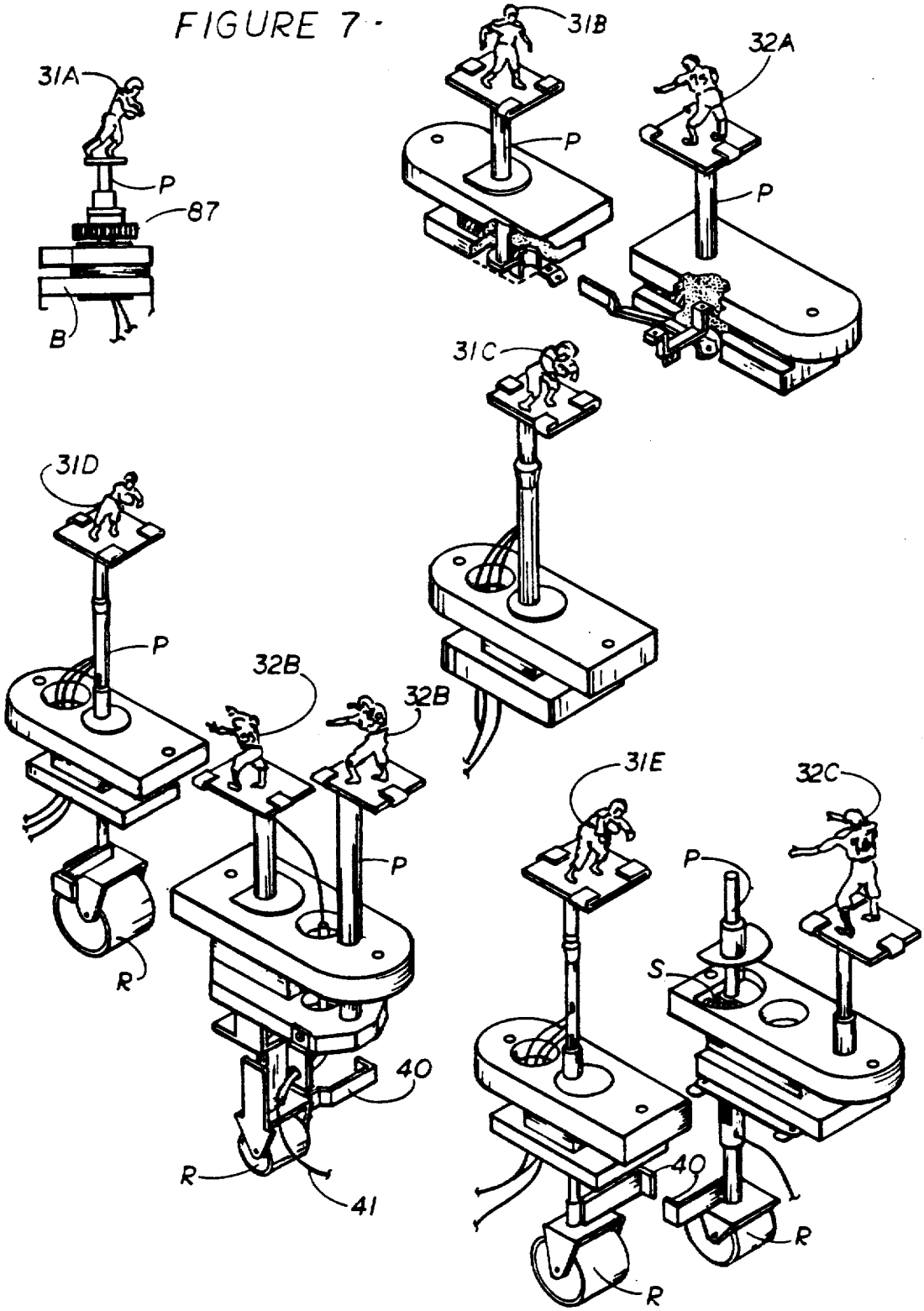
FIG. 7 is an exploded view of the preferred embodiment of the apparatus of the present invention illustrating the various player figurines.

In FIG. 5, a plan view of the board surface 13 show that a plurality of longitudinal slots 30S are provided, with each slot carrying a particular small football player figurine 31 (offensive) or 32 (defensive). Each figurine 31, 32 moves longitudinally along the slot between end portions 33, 34, of the game board. The game board carries imaginary transverse lines which are labeled G, 10, 20, 30, 40, 50, in the same fashion as a traditional football field as shown in FIG. 5. When a figurine moves from one transverse line to the next line this represents an advance of the ball for ten yards which gives a first down. In FIG. 7, the various player figurines 31, 32 are shown in more detail. The figurines shown in FIG. 7 include offensive player figurines 31 including quarterback 31A and offensive line player 31B, a center 31C a running back 31D, a wide receiver 31E. The defensive player figurines 32 include defensive lineman 32A, linebackers 32B, cornerbacks 32C. Notice that each player figurine 31, 32 rides upon a base B having a pedestal P portion upon which the figurine 31, 32 is mounted.

Figure 8:
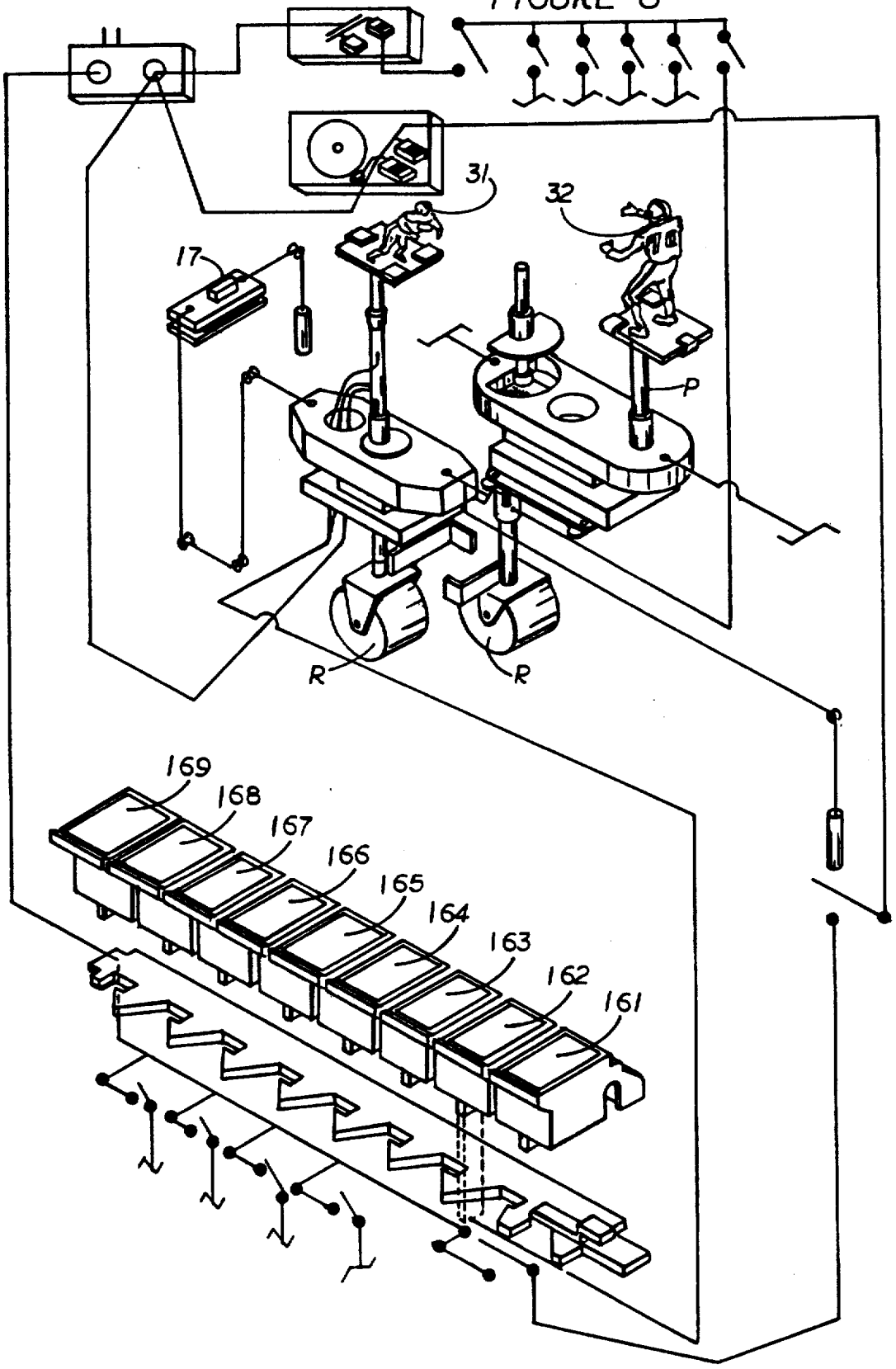
FIG. 8 is a schematic diagram illustrating the slide weight and counterweight and the electrical controls and circuits of the preferred embodiment of the apparatus of the present invention.

At least some of the figurines 31, 32 include rollers R (FIG. 8) so that the figurines can roll on a surface beneath the playing field as will be described more fully hereinafter. FIG. 8 also shows switch 161-169.

Some of the figurines 31, 32 include metallic contacts 40 which represent electrical connections so that electricity can be routed via a control wire 41 to a circuit. Notice that the wide receiver 31E and the cornerback 32C in FIG. 7 are shown with their respective contacts 40 aligned so that any forward movement of either the wide receiver or the cornerback will result in a connection being formed between the two contacts 40. This produces a closed electrical circuit which signifies a tackle which activates an electronic whistle in the preferred embodiment. Thus, when the two rollers are rolling on surfaces that are of equal elevation, the contacts of the players 31E and 32C will align and connect preventing further advancement of those players and further sounding the alarm. For example the wide receiver when advanced meets the cornerback 32C and a tackle results. The players can be rotatably mounted upon their pedestal so that they will then turn 45 degrees toward each other in a "hugging" fashion during "tackle". When the players are disengaged, the springs in the base of cornerback 32C-31E as shown in FIG. 7 will return the players to their original position. A misalignment of the rollers R occurs when a cam is used to raise one player to a higher elevation so that the contacts 40 will not engage.

Figure 6:
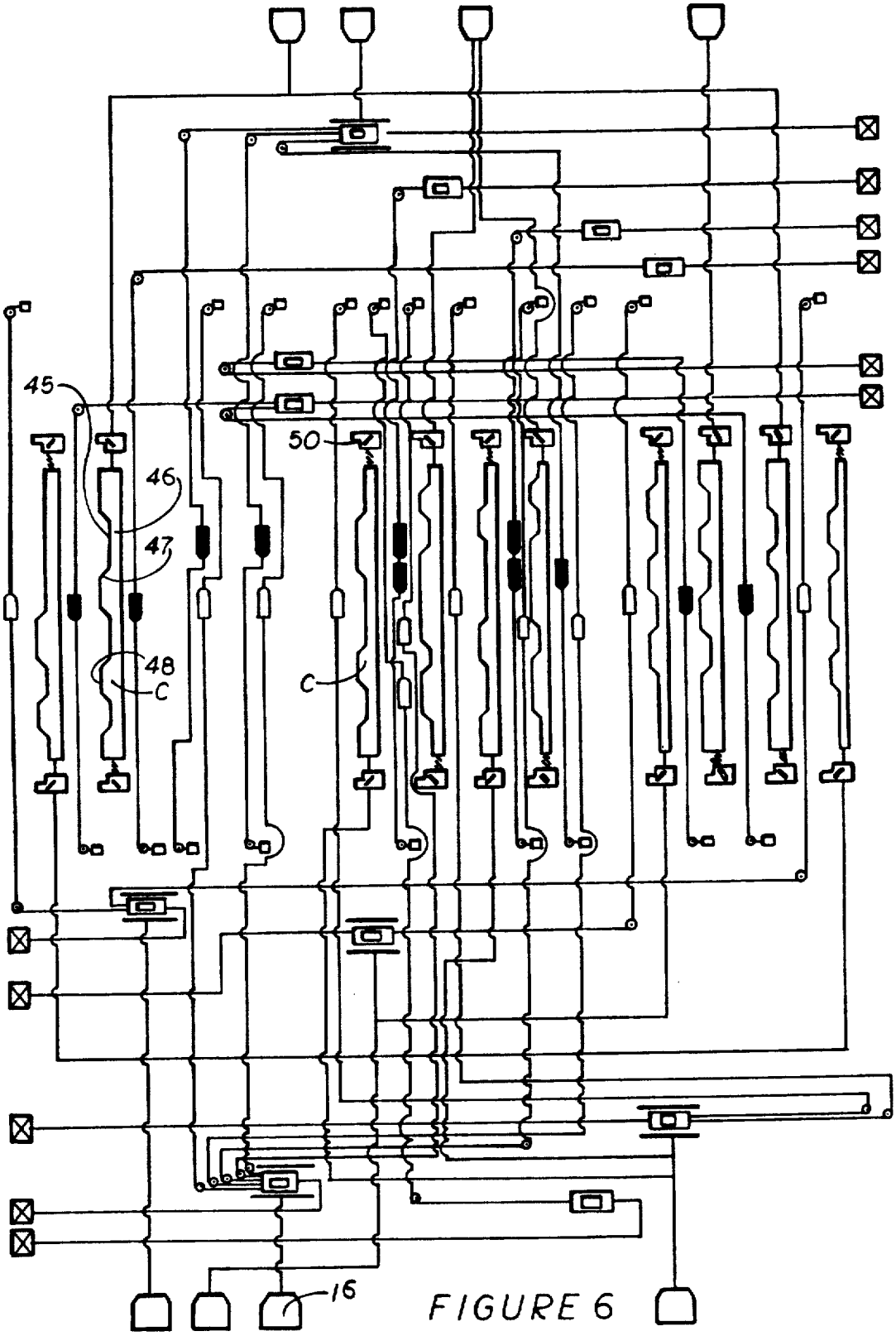
FIG. 6 is a schematic perspective view of the preferred embodiment of the apparatus of the present invention.

An inspection of FIG. 6 shows that a plurality of cams C are mounted below the gameboard surface 13 and upon angled slots 50 at their end portions. When the cam is moved by pulling using an elongated cable that is connected to one of the foot petals 16, the cam rises thus elevating the player figurine 31, 32. Notice that the upper surface 45 of each cam includes a varying elevational position including a lower position 46 a transitional position 47 and a higher position 48 so that the player actually moves in a programmed fashion, changing elevation as the player 31, 32 travels along the cam C. Thus the game can be very complicated and chancey depending upon which player 31, 32 is elevated and depending upon the configuration of the cam.

One skilled in the art will recognize that by substituting cams C of different configuration, a player 31, 32 can be made to rise and fall when the corresponding petal is actuated to activate the cam thus making the tackling of an opponent quite difficult to anticipate or stop. Further, at times failing to raise the cam may actually result in a score if the opponent has raised the cam of his defensive player thus a good bit complexity and chance is involved with the game of the present invention.

Figure 9:
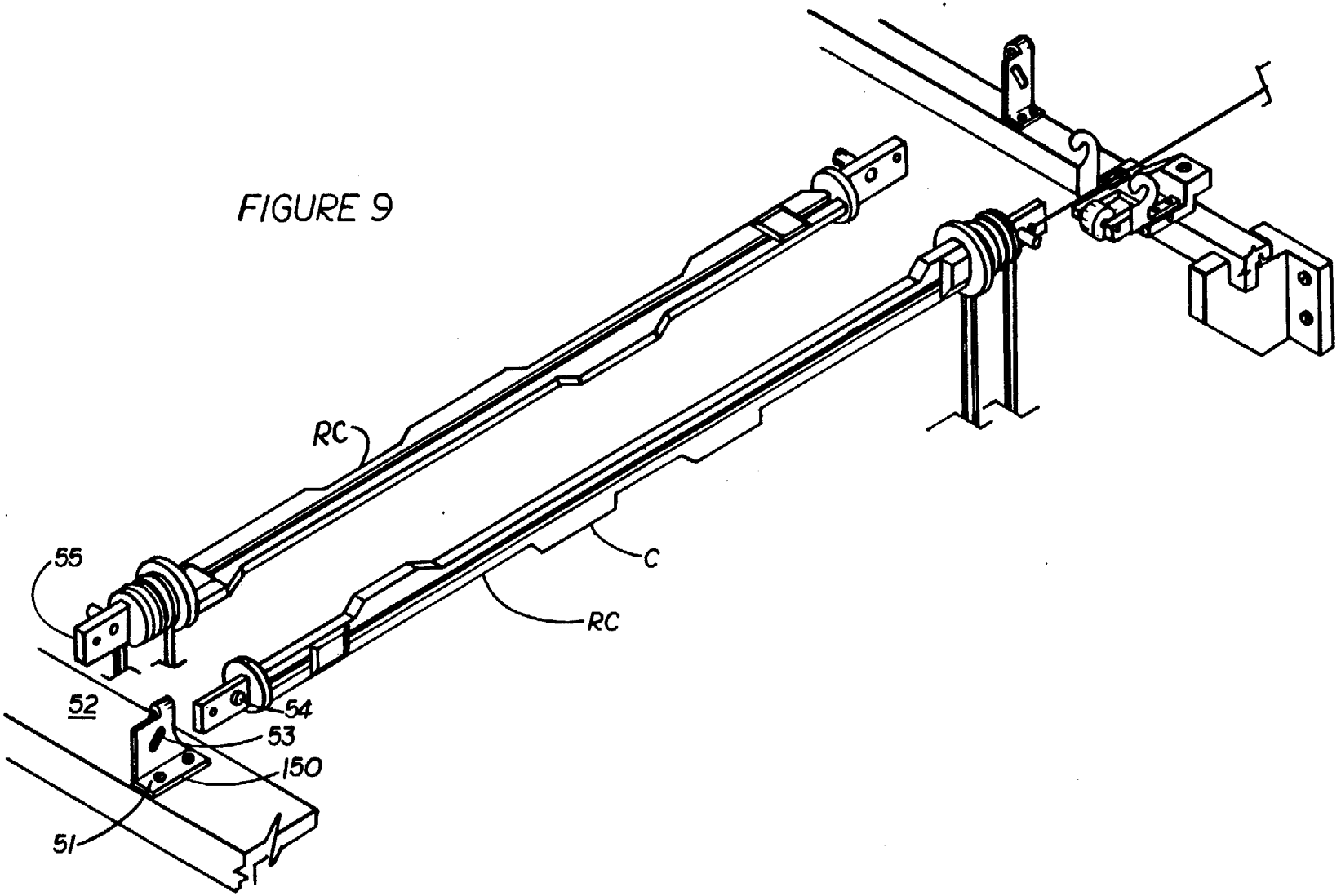
FIG. 9 is a fragmentary perspective view of the cam assembly portion of the present invention.

In FIG. 9, the cams C are shown as supported at one end portion by a bracket 150 which has a base portion 51 mounted to a metal beam for example 52 that extends transversely beneath the playing surface 13. Each bracket 150 includes a diagonal slot 53 with a pin 54 mounted in the diagonal slot. The pin is connected to an elongated metallic longitudinal support 55 which attaches by means of nails, screws or the like to each end portion of the cam. Thus when the cam C is pulled using a cable attached to the foot petal 16, the cam rises or falls depending upon the direction of orientation of the slots 53. Thus the cam is raised or lowered by depressing the appropriate foot petal 16. In FIG. 11, a layout of the cams C is illustrated showing that the cams can have different high and low points which are different for each respective slot. One skilled in the art will recognize that the cams can be configured in any desired way and interchange for example to change the game after a period of time when the cam positions have been learned by two opposing players thus the game can be constantly changed by substituting different cams or by changing cam positions.

In FIG. 10, a perspective view illustrates two players 31, 32 approaching one another with the player 31 being at a higher elevation because its roller R is on the upper surface 48 of a cam C. The player 32 however has its roller on a lowermost surface 46 of a cam C so that the player 32 is at a lower elevation thus, the contacts 40 of each respective player 31, 32 are misaligned and will not make contact as the player 31 moves forwardly in the direction of the player 32. The player 31 is shown carrying the football and that player will move on pass the tackler 32 and towards a score.

In FIG. 9, an optional rotating cam RC is illustrated which is mounted rotatably upon roller bearings that can be rotated using endless cable 51. By pulling on an endless cable, the cam RC rotates to that one of two surfaces is presented upwardly. This is a more complicated version of the cam which gives the player two optional cam surfaces rather than a single cam surface. Otherwise, the cam can be raised and lowered as with the cams C. However, the rotating cam doubles the number of cams which are available for a particular slot.

Figure 5:
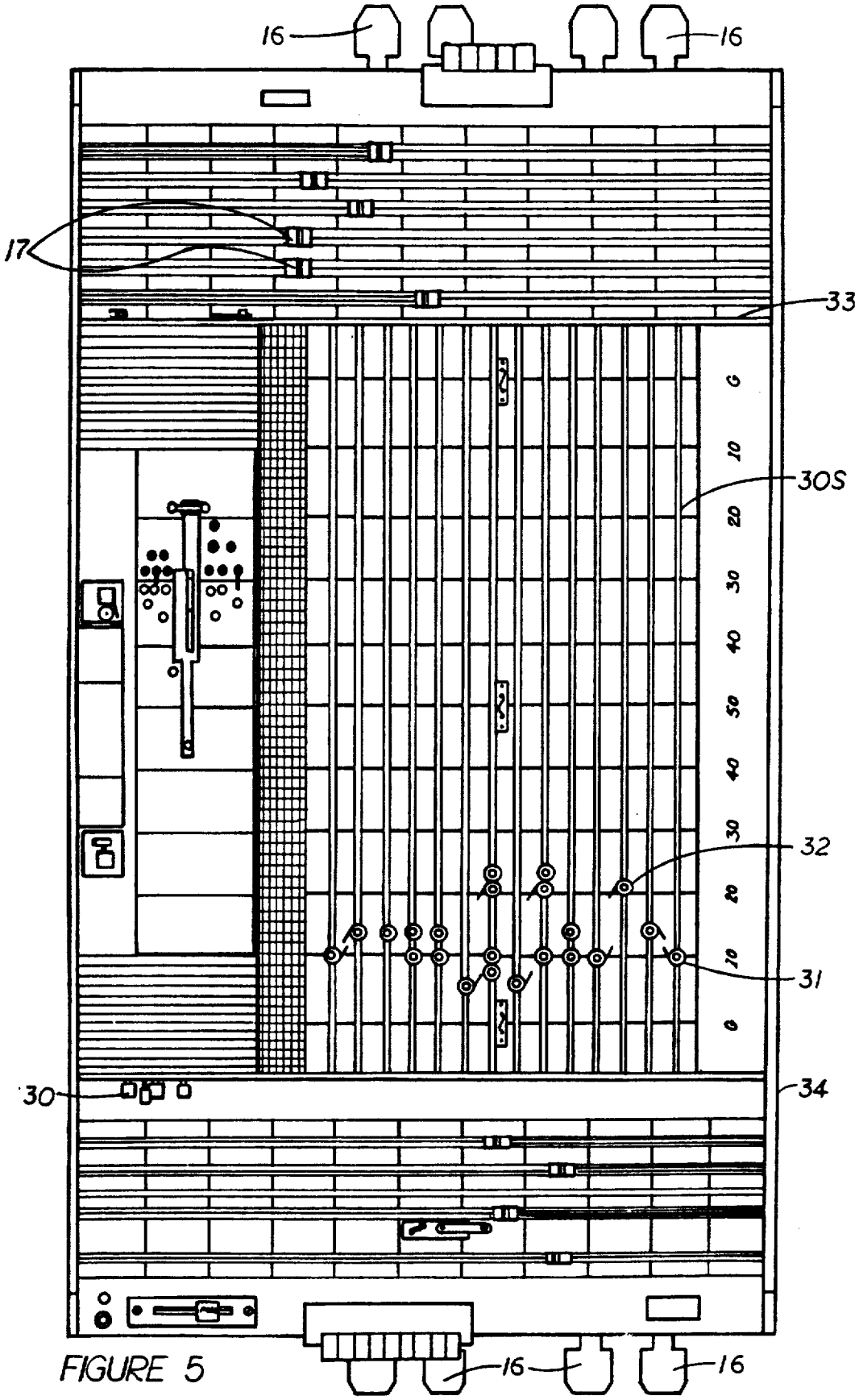
FIG. 5 is a top view of the preferred embodiment of the apparatus of the present invention.

In FIG. 4A, the operating parts of the kicking game are shown including a plurality of shafts 65–68. Each of the shafts 66, 67 carries pendulums 69, 70 each of which carries a lighted bulb at its end portion, designated by the numeral 71–72 respectively. The pendulums 69, 70 stay out of view until activated by a slide connected to the wound cables 75. When the slide is activated, the lock pin 77 is released and the shaft 66 swings the pendulum 69. Normally the shaft 66 contains a coil spring apparatus 76 which biases the shaft 66 to rotate. Locking mechanism 77, which is a detent lock for example, engages sprocket 78 of shaft 66, must be in a released position in order for the shaft 66 to rotate and for the pendulum 69 to swing. Cable segments 73, and 80 are actually the same cable, which engages shafts 67–68.

Shafts 67, 68 rotate as they are connected to shafts 67 by means of cables. Cable 81 is wound upon the shaft 68 and controls the player figurine 82 which raises the player figurine 82 responsive to a rotation of the shafts so that the player figurine 82 appears to rise and block the kick. The rotating shaft 65 pulls a cable which is connected to the kicker K so that the kicker moves forward, as shown by the arrow 85 in FIG. 4A.

The kicker's initial position is designated by the phantom lines in FIG. 4A. A counterweight 86 holds the kicker in the rearward position and responsive to a rotation of the shaft 65, the kicker moves forward when the pendulum 69 and the shaft 66 rotate. The kicker is then locked in position by the locking mechanism 95, and held in that position until the apparatus is readjusted to its original position by the user.

Figure 12:
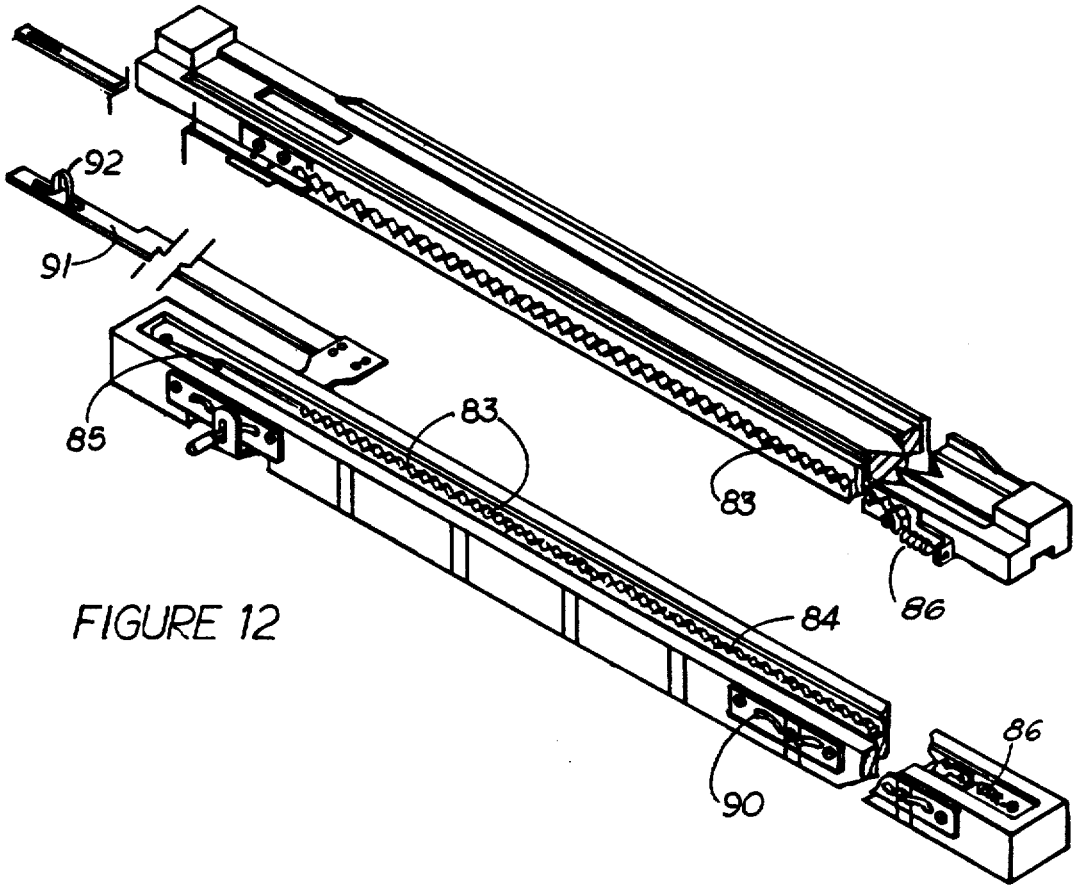
FIGS. 12-13 are fragmentary views of the preferred embodiment of the apparatus of the present invention illustrating the quarterback mechanism portion thereof.
Figure 13:
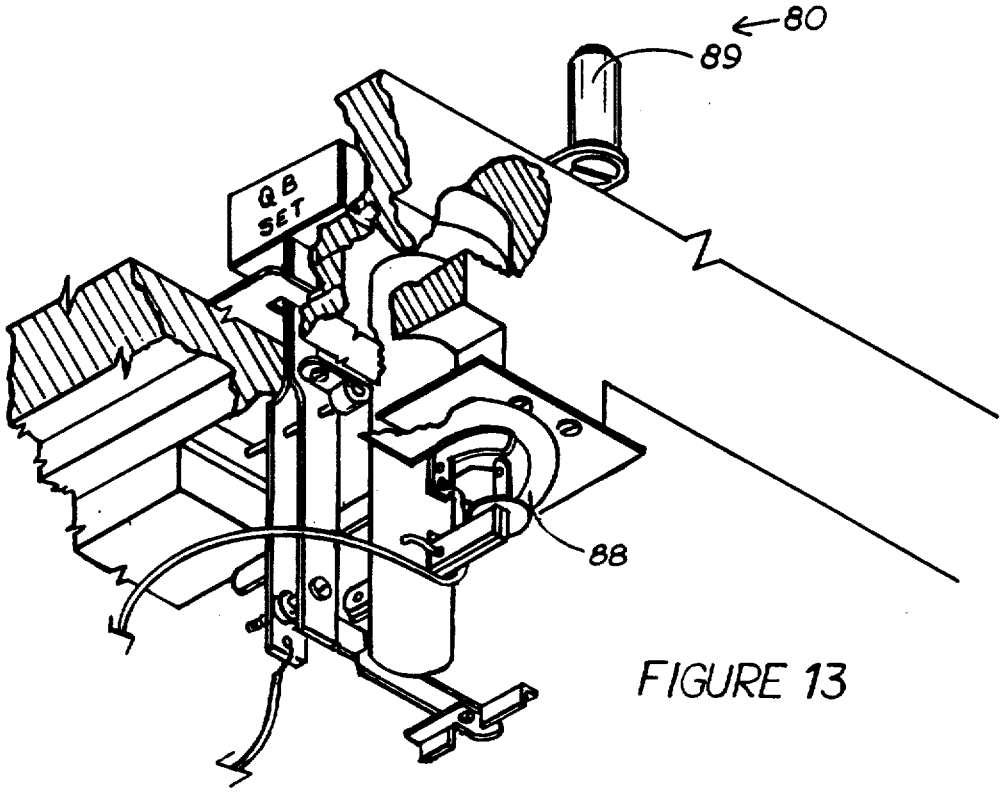

In FIG. 12–13 the quarterback turning mechanism 80 comprises of a pair of racks with teeth-like gears 83, 84 and springs 85, 86. Gear wheel 87 is fixed to the base of the quarterback 31A (FIG. 7). The rotary mechanism consisting of a pin 88 and a cranklike arm 89 mounted to the offensive control end 13. One rack 81 is mounted inside the quarterback 31A slot and fixed to a spring 85, 86 on each respective end, which is attached in place by means of bolts fixed to the rack and through a horizontal shaped slot 90. The rack 81 has an extension bar 91 with a loop 92 at its end connected to pin 88 which is attached to the rotary axis when the crank arm 89 is pushed forward. The rack 81 with its teeth 84 facing the gear wheel 87 will engage and turn the quarterback 31A, which will turn left. If the arm 89 is pulled back the quarterback will turn right. The springs 85, 86 on each end will disengage the gear 87 and retract the rack 81 to its original position.

Figure 14:
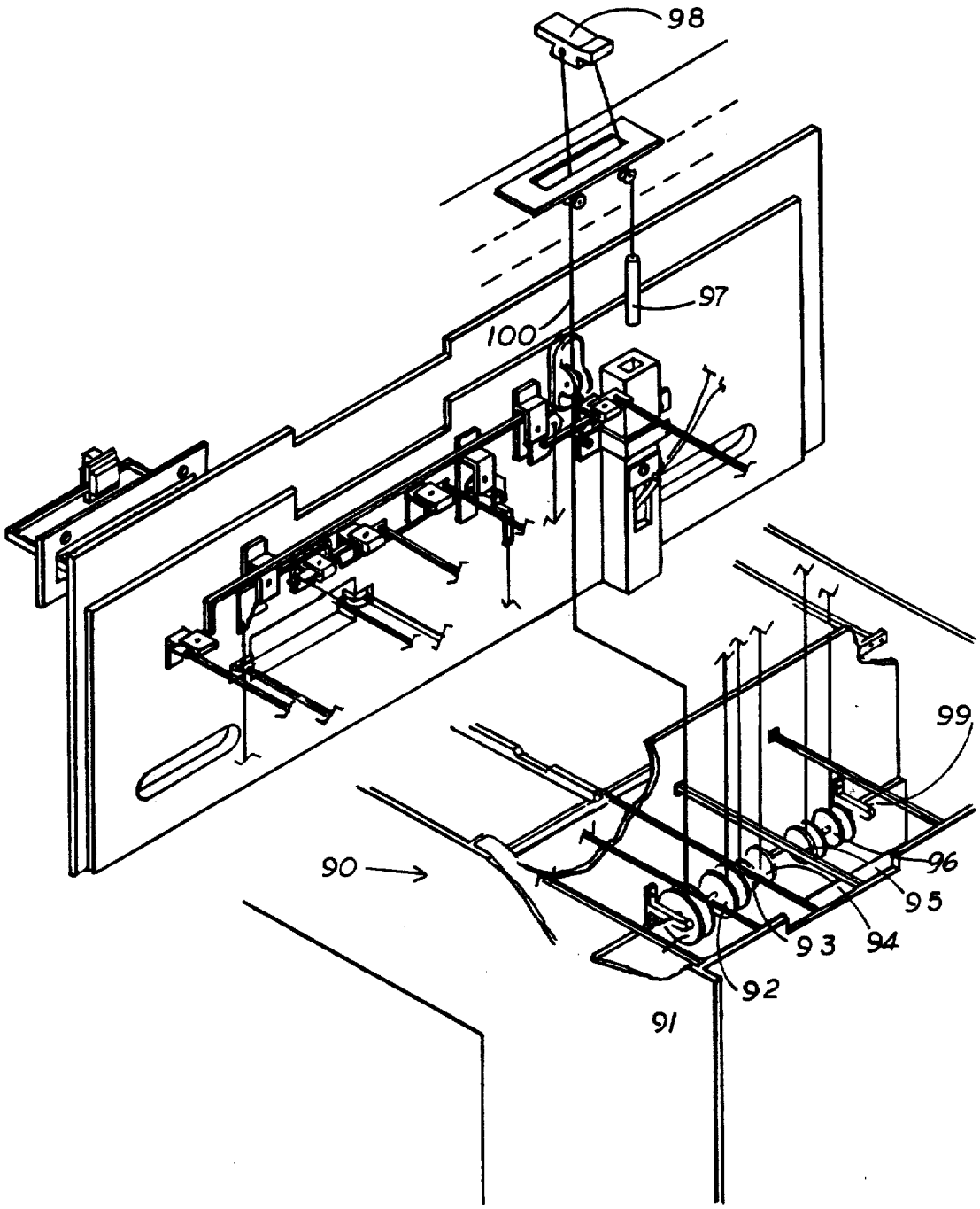
FIG. 14 is a fragmentary view of the pocket mechanism portion of the apparatus of the present invention.

The pocket mechanism 90 of FIG. 14 is comprised of a plurality of pulleys and cables. The pulleys 91–96 are of different size so that linemen move rearwardly to "protect" the quarterback in a cup shaped arrangement. Five linemen players 31B, one counter weight 97 and one slide 98 operate the six pulleys fixed to a common shaft 99 for a common rotation. The five pulleys 91–96 are sized with various circumferences to determine the distance for movement of each player 31B, for the same amount of turn or angle of the driving pulley that each player is pulled back from the line of scrimmage. When a slide 98 is activated which is connected by means of cable 100 to the driving pulley fixed to the common shaft 99, the linemen players 31B which are linked by cables (not shown) to the respective pulleys 92–96) will be in a passing or pocket formation, roughly semicircular in shape. The two tackles have the largest pulley wheel, the guards a smaller size pulley wheel and the center a smallest diameter pulley wheel.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A table top football game apparatus comprising:

(a) a table like base having a generally rectangular horizontal playing surface having end portions that include transverse end zone scoring areas;

(b) a plurality of elongated, parallel longitudinal slots disposed on the playing surface and extending to the end zone scoring areas;

(c) a plurality of football player figurines mounted upon the plurality of slots for sliding travel thereupon and between the end zone areas of the playing surface;

(d) goal lines at each end zone area of the playing surface, traversed by at least some of the slots;

(e) manually operable means for moving each player figurine in its respective slot and independently of at least some of the other player figurines;

(f) at least one of the figurines facing in opposite directions, thus defining offensive and defensive player figurines;

(g) first and second player control means, spaced apart and positioned at each respective end of the playing surface for moving the offensive and defensive player figurines respectively and independently from a remote location;

(h) contact means carried by at least some of the respective offensive and defensive player figurines for forming an electrical connection between an offensive and defensive player in adjacent slots when the two player figurines move to a position adjacent one another;

(i) indicator means for indicating contact between two player figurines to thus signal a tackle; and (i) position changing means for changing the elevational position of one or more figurines, and including a movable cam mounted under the slot, including an uneven surface traversed by the figurine.

2. The apparatus of claim 1 wherein the contact means is a metallic contact carried by the player figurine.

3. The apparatus of claim 1 further comprising audible means sounding when an offensive player figurine reaches an end zone area, registering a score.

4. The apparatus of claim 1 further comprising means connected to a plurality of offensive player figurines for forming a football pass pocket-like formation.

5. The apparatus of claim 1 wherein at least some figurines have rollers for rotatably engaging the cam.

6. The apparatus of claim 5 wherein at least some player figurines are supported upon respective generally vertical pedestal shafts extending through a slot and having the roller connected to the lower end of the pedestal shaft, and a metallic contact extends transversely from the pedestal shaft.

7. The apparatus of claim 1, wherein the movable cam is rotatable about a longitudinal axis parallel to one of the slots.

8. A table top football game apparatus comprising:

(a) a table like base having a generally rectangular horizontal playing surface having end portions that include transverse end zone scoring areas;

(b) a plurality of elongated, parallel longitudinal slots disposed on the playing surface and extending to the end zone scoring areas;

(c) a plurality of football player figurines mounted upon the plurality of slots for sliding travel thereupon and between the end zone areas of the playing surface;

(d) goal lines at each end zone area of the playing surface, traversed by at least some of the slots;

(e) manually operable means for moving each player figurine in its respective slot and independently of at least some of the other player figurines;

(f) at least some of the figurines facing in opposite directions, thus defining offensive and defensive player figurines;

(g) first and second player control means, spaced apart and positioned at each respective end of the playing surface for moving the offensive and defensive player figurines respectively and independently from a remote location;

(h) contact means carried by at least some of the respective offensive and defensive player figurines, for forming an electrical connection between an offensive and defensive player in adjacent slots when the two player figurines move to a position adjacent one another;

(i) indicator means for indicating contact between two player figurines to thus signal a tackle; and (j) position changing means disposed under the playing surface and generally hidden from view during play for allowing a user to change the position of one or more figurines, so that the contact means misalign allowing one figurine to pass an adjacent, oppositely facing figurine without electrical connection therebetween.

9. The apparatus of claim 8 further comprising a quarterback figurine that can rotate relative to the playing surface.

* * * * *